US007407017B2

(12) United States Patent
Robson

(10) Patent No.: US 7,407,017 B2
(45) Date of Patent: Aug. 5, 2008

(54) LOCKING MECHANISM

(75) Inventor: Angus Peter Robson, Matamata (NZ)

(73) Assignee: Rocktec Limited, Matamata (NZ)

( * ) Notice: Subject to any disclaimer, the term of this patent is extended or adjusted under 35 U.S.C. 154(b) by 0 days.

(21) Appl. No.: 10/532,771

(22) PCT Filed: Oct. 21, 2003

(86) PCT No.: PCT/NZ03/00236

§ 371 (c)(1),
(2), (4) Date: Feb. 6, 2006

(87) PCT Pub. No.: WO2004/035940

PCT Pub. Date: Apr. 29, 2004

(65) Prior Publication Data

US 2006/0201691 A1 Sep. 14, 2006

(30) Foreign Application Priority Data

Oct. 21, 2002 (NZ) ..... 522158

(51) Int. Cl.
*E02D 7/08* (2006.01)

(52) U.S. Cl. ..... 173/1; 173/53; 173/89; 173/90

(58) Field of Classification Search ..... 173/1, 173/53, 55, 124, 27, 184, 185, 89, 90
See application file for complete search history.

(56) References Cited

U.S. PATENT DOCUMENTS

| | | | | | |
|---|---|---|---|---|---|
| 2,378,131 | A * | 6/1945 | Dirksen et al. | ..... | 173/53 |
| 2,882,690 | A * | 4/1959 | Frederick | ..... | 173/124 |
| 3,205,952 | A * | 9/1965 | Sicotte | ..... | 173/124 |
| 4,050,526 | A * | 9/1977 | Deike | ..... | 173/27 |
| 4,193,459 | A * | 3/1980 | Engstrom | ..... | 173/193 |
| 4,747,455 | A * | 5/1988 | Cunningham | ..... | 173/1 |
| 4,755,080 | A * | 7/1988 | Cortlever et al. | ..... | 405/50 |
| 4,993,500 | A * | 2/1991 | Greene et al. | ..... | 173/1 |
| 5,012,873 | A * | 5/1991 | Kennedy et al. | ..... | 173/185 |
| 5,490,740 | A * | 2/1996 | Johnson | ..... | 299/37.4 |
| 6,003,619 | A * | 12/1999 | Lange | ..... | 173/184 |
| 6,109,365 | A * | 8/2000 | Lamoureux et al. | ..... | 173/90 |
| 6,439,317 | B1 * | 8/2002 | Minotti et al. | ..... | 173/89 |

* cited by examiner

*Primary Examiner*—Scott A. Smith
(74) *Attorney, Agent, or Firm*—Stephen M. De Klerk; Blakely, Sokoloff, Taylor & Zafman

(57) ABSTRACT

The present invention relates to a method of securing a shaft at any point along its substantially vertical axis of movement, wherein the method includes a locking device that is moveable with respect to the shaft. The method is characterised by the step of moving the locking device into a position wherein at least one face of the locking device mates against at least one point on the shaft so as to secure the shaft at any point along its substantially vertical axis of movement. In particular this invention relates to a method of securing a drop hammer at any point along its substantially vertical axis by use of a hydraulically controlled cam.

9 Claims, 3 Drawing Sheets

LOCKING MECHANISM

CROSS REFERENCE TO OTHER APPLICATIONS

This is a National Phase of International Application No. PCT/NZ2003/000236, filed on Oct. 21, 2003, which claims priority from New Zealand Patent Application No. 522158, filed on Oct. 21, 2002.

TECHNICAL FIELD

This invention relates to a lock for application to a moveable shaft.

In particular, it relates to a lock for securing a shaft, capable of substantially vertical movement, at any desired height along its axis.

BACKGROUND ART

Drop hammer devices are used to break up concrete, building material, rock, solid ground or the like. By breaking up concrete or building material into smaller pieces, the pieces are reduced to manageable sizes, ready to be removed by excavators and loaders or the like. By breaking up ground, access is allowed to the material or soil below. This is particularly applicable when working with frozen ground such as permafrost.

Other types of machinery used to break up concrete or the like include hydraulic hammers and Pulverisers. Hydraulic hammers are limited to functioning only for their intended purpose, which is to break material into smaller pieces. A number of hydraulic hammers have been broken by operators attempting to use them as a rake or sweep to move broken material away from the breaking zone. Pulverisers are used to grip onto walls or the like and squeeze them, thus crushing the material between. A disadvantage of a nipper is that is has only one intended purpose and therefore other machinery is required if the job has multiple requirements.

If any attempt is made to rake with a drop hammer device, the hammer itself will retract back into the casing at any sign of downward or sideways pressure. The hammer inside the casing is not secured directly to any part of the casing, it is instead held in position by the sides of the casing, but they act only as a guide.

Therefore, any substantially downward or sideways pressure will only push the hammer back into the casing, as the hammer is not secured. Therefore, a drop hammer device cannot usually be used for raking either.

It is common practice for a number of machines to work in conjunction with each other at a breaking site. A drop hammer device mounted on an appropriate piece of machinery will break up the area required. An excavator or loader will then move in to remove the broken material and the drop hammer device will then be moved to the new position for breaking and the cycle continues.

It is also common practice for a single machine to use two attachments, particularly on small jobs. The machine will use one attachment to undertake part of a job, switch between a bucket and a hammer and then continue the job. This type of operation has a number of disadvantages in that the operator must disconnect hoses and reconnect them to the new attachment. Each time the hoses are disconnected, hydraulic fluid will leak out, raising environmental concerns over site contamination. Additionally, the time taken to undertake such a changeover means increased downtime and a higher skill level for the operator.

It can be expensive to use multiple pieces of machinery for demolition and cleanup. These machines are charged out at an hourly rate and either the drop hammer device or removal machinery will sit idle while the other completes its job.

It would be an advantage to have a piece of machinery that could both break material and move it away from the breaking zone so that other machines could work alongside without requiring the drop hammer machinery to halt operation.

Drop hammer devices currently in use cannot fulfil this role in their present configuration as a hammer is configured to move in a substantially vertical direction from a raised to a lowered position. They are not designed to be used in a raking motion as they are not secured to the hammer housing.

It should be appreciated that while drop hammer devices are not designed to be used in a raking motion, they can be operated at angles substantially away from the vertical plane. This freedom of movement away from the vertical allows drop hammer devices to be used to break uneven portions of concrete, and low lying walls or the like and extends the number of places a drop hammer device can be utilised.

A prior art breaker of the applicant's design is used in demolition work connected to an articulated arm of an excavator, skid steer or like machine. The breaker has a housing in which a drop hammer is received. A drive mechanism, enclosed in the housing includes a loop of chain having a dog fixed thereto and a motor for rotating the chain, the dog abutting a projection on the hammer to raise the hammer, moving it away from an opening end of the housing. The hammer is then dropped to extend from opening end of the housing to impact the working surface. Although this tool performs satisfactorily, a number of tool changes on the excavator (e.g. swapping the breaker with a bucket) are required during a demolition operation since the breaker cannot be used for pushing or raking broken material to clear the work area.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

It is acknowledged that the term 'comprise' may, under varying jurisdictions, be attributed with either an exclusive or an inclusive meaning. For the purpose of this specification, and unless otherwise noted, the term 'comprise' shall have an inclusive meaning-i.e. that it will be taken to mean an inclusion of not only the listed components it directly references, but also other non-specified components or elements. This rationale will also be used when the term 'comprised' or 'comprising' is used in relation to one or more steps in a method or process.

It is an object of the present invention to address the foregoing problems or at least to provide the public with a useful choice.

Further aspects and advantages of the present invention will become apparent from the ensuing description which is given by way of example only.

DISCLOSURE OF INVENTION

According to one aspect, the present invention provides an apparatus for connection to an excavator or other machine, the apparatus including:

a hammer having an impacting end for impacting a working surface;

a drive mechanism for reciprocating the hammer;

a housing in which the hammer is received, the housing being configured for attachment to said machine, the impacting end of the hammer extending in use from an open end of the housing;

a locking mechanism including a locking member and an actuator, characterised in that the actuator is capable of forcing a hammer-engaging face of the locking member to engage at one or more points along a face of the hammer to lock the hammer within the housing such that the impacting end protrudes from the open end of the housing, thereby allowing the protruding end of the hammer to also be used for pushing or raking material.

The term 'hammer' in accordance with the present invention should be understood to mean an elongated block or pole that can be moved along a substantially vertical axis. It should be appreciated that the axis can be angled up to approximately 89° either side of vertical as desired. However, this angling of the hammer can only be achieved when the hammer and its housing are moved as a single unit. The hammer itself has some freedom of movement within its housing, but only sufficient to allow for normal activity, as known to someone skilled in the art.

The hammer is an elongated piece of heavy material designed to be pounded into an area to result in failure of the material underneath, be it concrete, building material, rock, ground, or the like. However, these are listed by way of example only and should not be seen to be limiting. It should be appreciated that the hammer can be enclosed within a housing, the housing including a mechanism configured to lift the hammer to a raised position. Once the hammer is in the raised position it can be released and due to the weight of the hammer, gravity will accelerate the hammer into the area beneath the hammer, imparting a large impact force and breaking or weakening whatever is situated beneath the impact zone.

It should further be appreciated that the hammer could be in the shape of a cylinder or an elongated box with multiple faces, or variation thereof as these are listed by way of example only and should not be seen to be limiting.

In preferred embodiments the hammer is an elongated vertical column with multiple faces.

It should be appreciated that the hammer does not normally include any internal attaching means to secure the hammer to the hammer housing, instead the hammer is held in place by the hammer housing, but it is not usually physically attached to it. Upon activation, the raising of the hammer can be undertaken by any number of mechanisms that impart lift. The mechanisms used to lift the hammer into position are known to someone skilled in the art and can include a cable attached to the upper end of the hammer or a chain and dog arrangement that engages a protrusion that extends from the hammer itself, however these are listed by way of example only.

In one embodiment, the locking member is a cam and the actuator pivots the cam to press a hammer-engaging face of the cam to engage with a face of the hammer to lock the hammer within the housing, the cam being shaped such that any force acting to pushing the hammer into the housing With the locking mechanism engaged acts to rotate the cam and thereby hold the hammer more firmly.

Preferably, the locking member engages with a face of the hammer by rotation about a first axis of rotation, the locking member having an eccentric rotational peripheral profile about said first axis of rotation.

According to one aspect of the present invention, rotation of the locking member in the engaged position due to upward movement of the hammer increases the force of engagement engaged between the locking member and the hammer.

Preferably, said rotation causes portions of the eccentric peripheral profile with an increasing radius into contact with the hammer.

In a further embodiment the actuator causes rotation of the locking member about said first axis of rotation via at least one intermediate linkage, pivotally attached about a second and third axis of rotation to the locking member and actuator respectively.

Preferably, a projection is provided on the hammer and the drive mechanism includes a loop of chain having at least one dog fixed thereto and a motor for rotating the chain, the dog abutting the projection to move the hammer away from the opening end of the housing.

The drive mechanism is preferably mounted within the housing.

Preferably, both the drive mechanism and actuator are hydraulically powered.

According to a preferred embodiment, the apparatus is connected to an excavator or other machine via an articulated arm.

The term 'dog' in accordance with the present invention should be understood to mean a catch physically attached to the chain that protrudes outwards, and will engage any protrusion extending from the drop hammer. The term 'dog' is known to someone skilled in the art, but should not be seen to be limiting.

According to a further aspect, the present invention provides a method of locking a hammer in an apparatus, substantially as hereinbefore described, within the housing such that the impacting end protrudes from the open end of the housing, thereby allowing the protruding end of the hammer to be used for pushing and/or raking material, said method including;

activating the actuator to engage a hammer-engaging face of the locking member at a point along a face of the hammer to lock the hammer to the housing.

According to a yet further aspect, the present invention provides a method of locking a hammer within the housing of an apparatus adapted for connection to an excavator or other machine to allow an impacting end of the hammer to protrude from the open end of the housing enabling the protruding end of the hammer to be used for pushing and/or raking material, the apparatus including:

a hammer having an impacting end for impacting a working surface;

a drive mechanism for reciprocating the hammer;

a housing in which the hammer is received, the housing being configured for attachment to said machine, the impacting end of the hammer extending in use from an open end of the housing;

a locking mechanism including a locking member and an actuator, said method including;

activating the actuator to engage a hammer-engaging face of the locking member at a point along a face of the hammer to lock the hammer to the housing.

Preferably, the hammer-engaging face of the locking member engages the hammer at any selected point along at least a portion of a hammer face.

The term 'protrusion' in accordance with the present invention should be understood to mean at least one extension of a portion of the drop hammer out to the side of the drop hammer so it is available to be engaged by the dog.

It should be appreciated that there can be more than one protrusion which can be positioned on any vertical side of the drop hammer.

In preferred embodiments, the mechanism used to lift the hammer into its peak vertical position is the chain and dog arrangement. The chain rotates around at least two sprockets positioned lengthwise to the drop hammer. The chain has at least one dog attached to it that engages the protrusion, or protrusions positioned on the hammer. As the chain is rotated, the hammer will lift as the dog attached to the chain rises. As the hammer reaches its maximum vertical height, the dog attached to the chain rotates around the sprocket and the hammer is released as the protrusion is positioned to the side of the sprocket.

It should be appreciated that any locking device could be positioned to abut against any point anywhere on the hammer.

It should also be appreciated that the vertically rotating chain could either be parallel with or perpendicular to the hammer. Accordingly, any locking device could be positioned between the rotating chain, as the chain would, in preferred embodiments, be oriented parallel to the hammer, rather than perpendicular to it in order to reduce the overall size of the hammer housing and therefore the overall weight of the unit as a whole.

The term 'locking device' in accordance with the present invention should be understood to mean a friction-based lock such as a cam, magnet or any-locking means that utilises the onset of friction between two faces as they mate together to lock an item into a position, although these are listed by way of example only and should not be seen to be limiting.

By using a friction based locking device, the likelihood of damage to the locking device or the mechanism around it is reduced. If a pin based locking device where a pin enters a recess were used, the likelihood of the pin shearing over time due to impact wear would be higher. If the locking device was activated while the hammer was moving, any pin based locking device would more than likely be sheared off due to the downward force of the hammer. The use of a friction based locking device would mean that even if the lock were activated while the hammer was falling, the friction created by the two faces meeting would only serve to slow the hammer down and lock it into place, not shear the cam off it's rotational axis, although it is not envisaged that the lock would be engaged while the hammer is in vertical fall.

It is an advantage of a friction-based lock that there is a reduced likelihood of damage to the lock due to shearing or the like.

The term 'cam' is a term known to someone skilled in the art and refers to a substantially flat projection on a rotating part in machinery.

In preferred embodiments the locking means is a cam configured so that on activation the cam will rotate and the substantially flat face will turn and meet, or mate with the face of the hammer at whatever position the hammer is in.

Cams are versatile and will allow slip between the two 'mating' faces should the force applied to the hammer overcome the strength of the lock. This slip therefore reduces the likelihood of destruction of the locking means in unusual circumstances.

It should also be appreciated that cams can be self tightening. As the rotation of the cam is in a clockwise direction to bring the substantially flat face up against the hammer, any upward pressure of the hammer against the cam face will only serve to tighten the lock.

It is also an advantage of this type of locking means that the hammer can be secured at any height. The length of protrusion of the hammer out of the hammer housing can therefore be varied as desired by the excavator operator.

This is a distinct advantage over any locking mechanism that uses a pin and recess arrangement. Either recesses must be positioned at multiple points along the hammer, or there limited locking positions available. A friction based locking means can be activated at any point along the length of the hammer.

If the operator is using the hammer to break material, the hammer itself can be secured with any desired portion of the hammer extending out of the hammer housing. If the broken material is of a thicker nature, a larger portion of the hammer can be set to protrude from the hammer housing. The material can then be raked or moved in the horizontal motion to one side so that other machines can work alongside the hammer mechanism to remove the material.

This has a distinct advantage over the prior art as it allows both hammer and removal machines to work concurrently rather than consecutively. This has key advantages in reducing the costs to undertake a job as the time to complete the job is faster.

Another advantage of the present invention is that the addition of a locking mechanism allows a single machine to do the job of two machines. Both hammering and raking can be undertaken by the same machine, saving time and money and potentially increasing the safety of a worksite due to less heavy machinery working in a demolition site.

The ability to lock the hammer at any desired protrusion length is a further advantage in that the hammer length can be set to provide the operator with maximum visibility, therefore increasing operator comfort. The operator can also lock the hammer at any length, making the job effectively easier as there is less likelihood of damaging the hammer through incorrect usage.

The ability to lock the hammer in any desired position along its vertical axis is a distinct advantage over any standard drop hammer device as the drop hammer is usually not attached to any hammer housing. As such, any pressure applied to the hammer will push it back up into the housing, making raking or sweeping of material impossible.

In other embodiments, the locking means could be a mating face with a negative gradient that abuts a specially configured mating face on the hammer with a positive gradient. When the mating face of the locking means is rotated to abut the hammer the hammer is locked in place.

The direction of the slope of each mating face is important as if the hammer receives a knock, the locking means will tighten rather than release.

According to another aspect of the present invention there is provided a locking device for reversibly locking a hammer at any point along its substantially vertical axis of movement wherein the locking means has a mating face, that once activated, will position itself against the mating face of the hammer to secure it in position.

The term 'mating face' in accordance with the present invention should be understood to mean the substantially flat surface of one portion of the locking means as one half of the pair of mating faces, and the substantially flat surface of the vertical portion of the hammer.

While the locking means utilises friction in order to secure the hammer in place, the pressure provided to the mating faces to increase friction to initiate locking can be undertaken by a number of means.

In preferred embodiments, a cam is used as the locking means. The rotation of the cam can be controlled by a hydraulic system.

The advantage of controlling the movement of the cam by hydraulics is that the hydraulics controlling the main housing can be tapped into to provide the further controlling means for the cam, therefore simplifying the addition of the locking device to drop hammer devices already in use.

Another advantage of using hydraulics to control the cam is that the abutment of the mating faces is by pressure, the preferred outcome of hydraulic application.

It is envisaged that when the hammer is being used as originally intended; moving through a substantially vertical trajectory, the locking means will remain in the unlocked position with the hydraulic controls in the off position. This will keep the two mating faces separate from each other and allow the hammer to fulfil its job.

It should be appreciated that it would be virtually impossible to lock the hammer in place while the hammer is operating as the hydraulic controls that activate the cam lock also activate the hammer itself. For one to work the other must be non-operational, therefore making it physically impossible to work the lift and lock mechanism at the same time, which reduces the likelihood of unintentional damage to the machine.

It should however be appreciated that the hammer could be used at any angle away from the vertical, provided there is sufficient force provided by gravity or some other propulsion means.

When the control means in the cab of the carrier is activated, therefore engaging either a forward or sideways motion to the carrier and therefore the hammer itself, the hydraulic mechanism will be activated, the cam rotated and the hammer locked in place.

Accordingly, whatever position the hammer is in with respect to the hammer housing at the time of activation of the cam, the hammer will be locked into that position.

It should therefore be appreciated that the height of the hammer can be easily varied by pausing the vertical lift of the hammer housing and activating the cam.

It should also be appreciated that the hammer could be rested on the ground and the hammer housing moved with respect to it to push the hammer into the housing to the desired distance.

It is an advantage of the present invention that the drop hammer device itself has, by the addition of a lock, become a complete tool for both the breaking and moving of material. The end of the hammer is not only used for its impact, but also to rake material away from the work zone.

It is the inventor's opinion that a locking means designed to secure a hammer in a desired position to allow a raking or pushing movement has never been undertaken before. The combination of the locking means with the hammer means that a job undertaken by a drop hammer device can be completed in shorter time because not only can broken material be dragged to one side, but a larger partially broken piece could also be positioned for a second impact, making the job of the assisting machinery easier.

BRIEF DESCRIPTION OF DRAWINGS

Further aspects of the present invention will become apparent from the following description which is given by way of example only and with reference to the accompanying drawings in which.

BEST MODES FOR CARRYING OUT THE INVENTION

Figure 1:
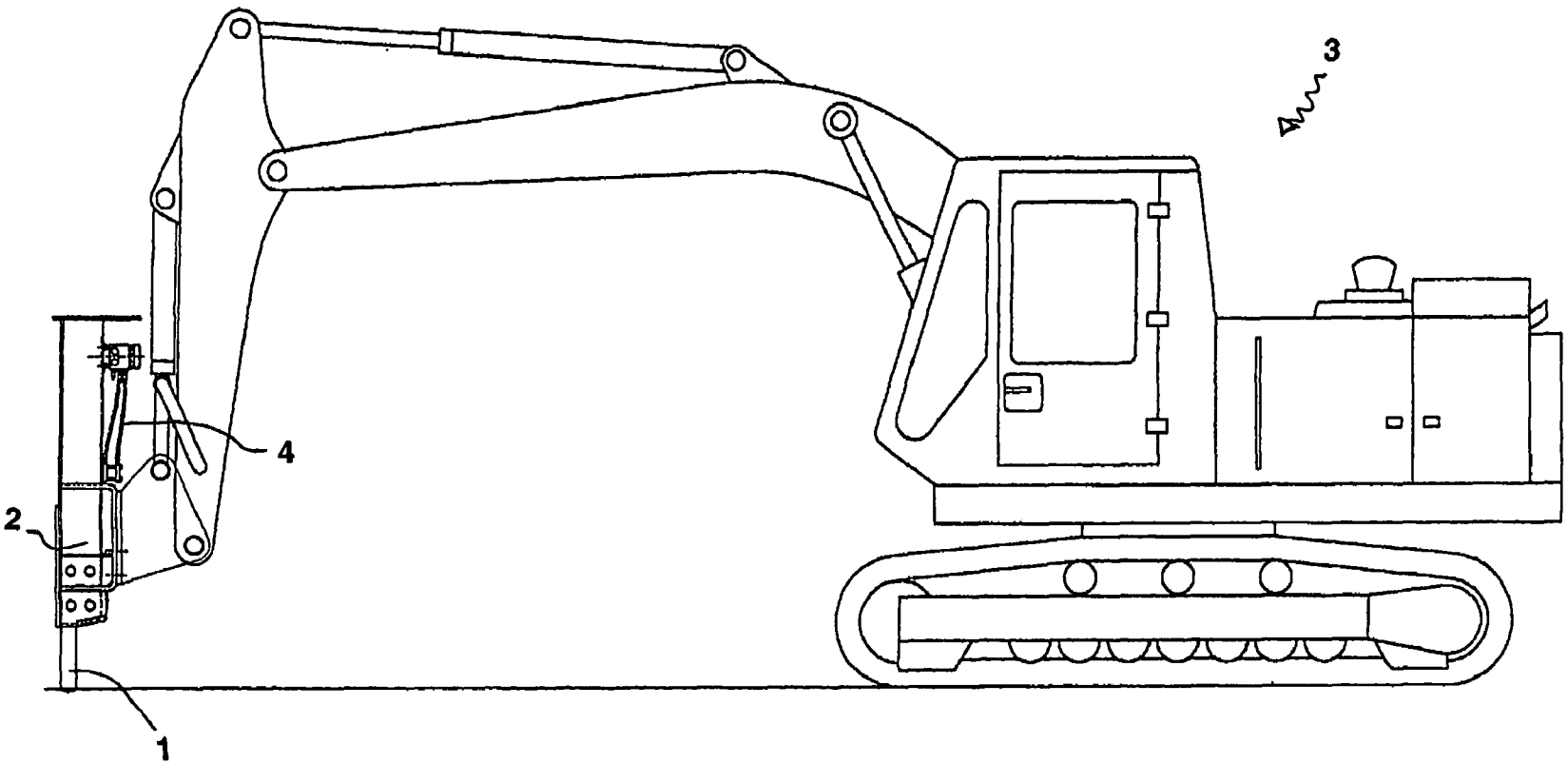
FIG. 1 is a diagrammatic illustration of a preferred embodiment of the present invention.

With reference to FIG. 1, there is illustrated a hammer (1), encased within a hammer housing (2) which is attached to a hydraulic excavator generally indicated by arrow 3.

Also illustrated in FIG. 1 is the hydraulic activation means (4) for use to engage the locking device (not shown in this figure).

Figure 2:
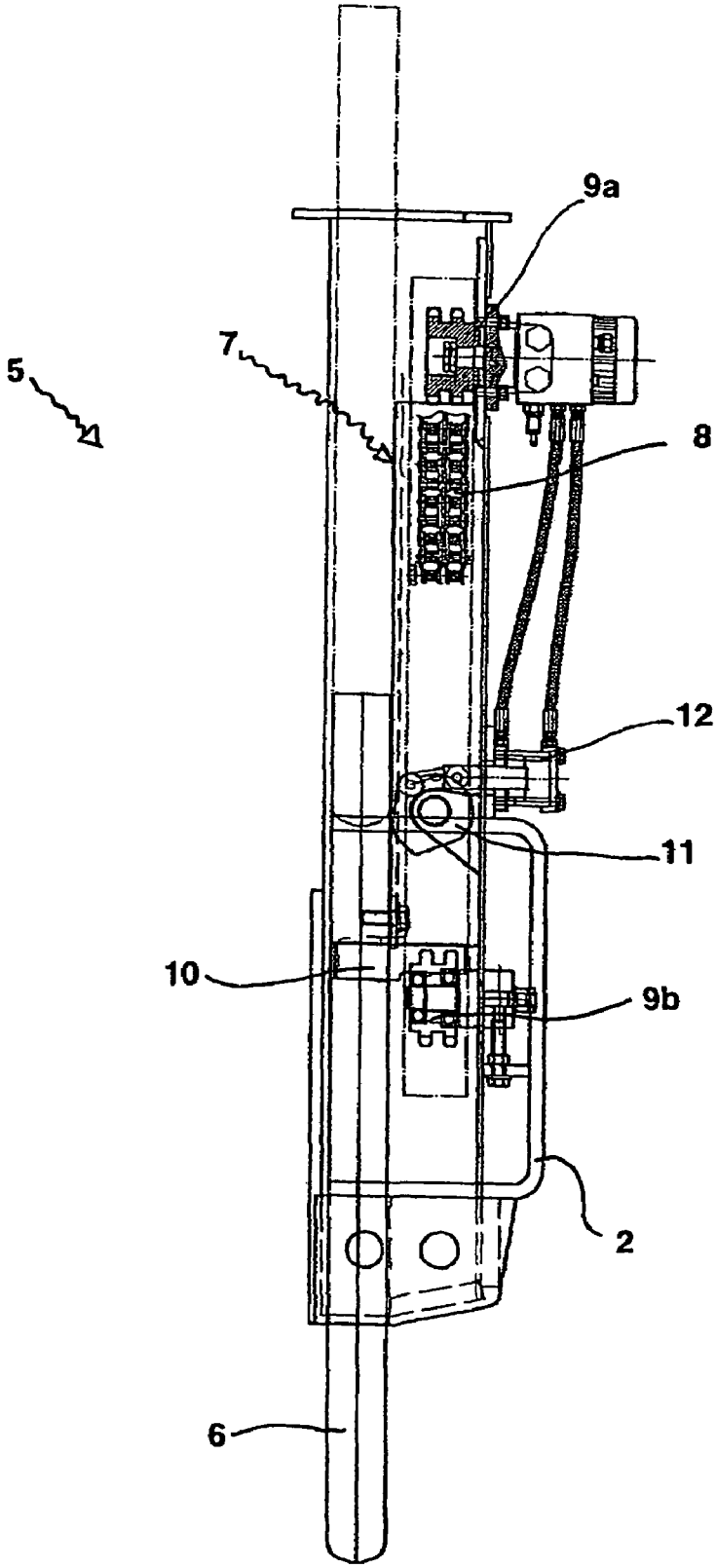
FIG. 2 is a diagrammatic representation of a preferred embodiment of the present invention showing a cam as the locking device.

With respect to FIG. 2 there is shown a close-up of a drop hammer device generally indicated by arrow 5. The drop hammer device 5 consists of a hammer (6), a raising mechanism generally indicated by arrow 7 in the form of a rotating chain (8), two end sprockets (9*a* and *b*), a protrusion (10), a cam lock (11), a hydraulic activating means (12) and a hammer housing (2).

Figure 3:
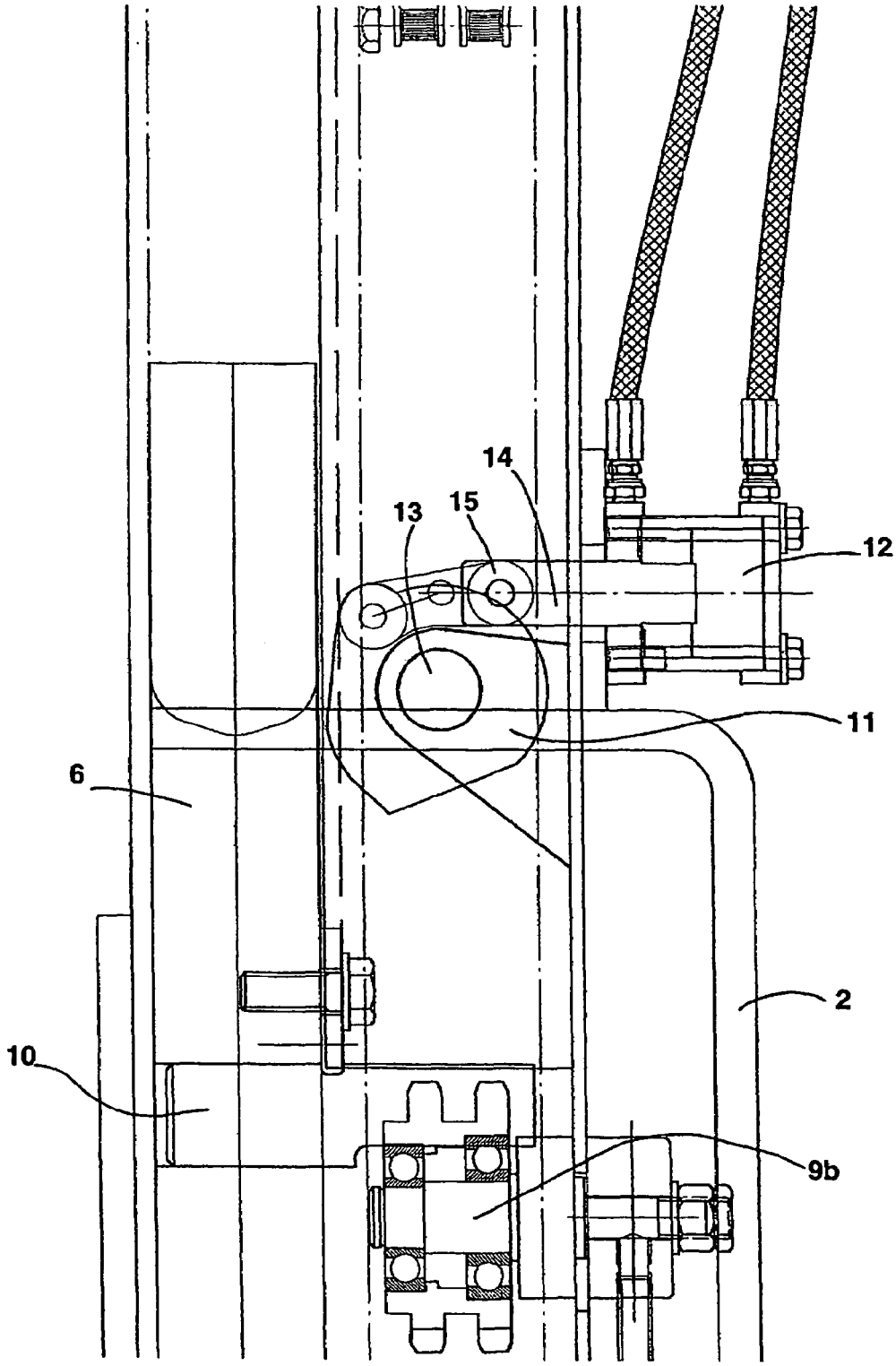
FIG. 3 is a close-up of the diagrammatic representation of one preferred embodiment of the present invention.

With respect to FIG. 3, there is shown a close-up of the cam lock (11) and the hydraulic activating means (12). Also shown are the rotating chain lower sprocket (9*b*), the protrusion (10), the hammer (6) and the hammer housing (2).

When the hammer (6) is operating, the rotating chain (8) containing at least one dog (not shown) rotates.

The dog abuts the protrusion (10) situated on the side of the hammer perpendicular to the rotating chain (8).

As the chain (8) rotates, the dog rises, lifting the protrusion (10) which in turn raises the hammer (6).

When the protrusion (10) rises to a point level with the upper sprocket (9*a*), the dog rotates over the top of the upper sprocket (9*a*) and releases the protrusion (10), allowing the hammer to fall.

When the hammer (6) has completed its fall, the dog will rotate around the chain (8) and then abut the protrusion (10) and repeat the vertical lift.

In order to lock the hammer (6) in any position along it's trajectory, the cam (11) is rotated around its axis (13) by means of an actuator (14) which is controlled by the hydraulic activating means (12).

The actuator (14) is made up of two parts that pivot at the joint (15). The forward motion of the actuator (14) combined with the pivoting of the actuator at it's joint (15) allow the cam (11) to rotate to engage the hammer (1). This means that the hammer can be engaged at any point along its trajectory.

Once the hammer (6) is locked in a position by the cam (11) it can then be used at any angle, rather than just vertical, to rake material or position material for further impacting.

The operator can initiate the engagement of the cam (11) by activation of the hydraulic activating means (12) from inside the hydraulic excavator.

It should also be appreciated that the initiating of the cam (11) will either disengage or halt the raising mechanism (7), or push the hammer (6) away from the raising mechanism (7)

and up against the far side of the hammer housing (12) so that the catch mechanism cannot engage the protrusion (10) and raise the hammer (1).

Aspects of the present invention have been described by way of example only and it should be appreciated that modifications and additions may be made thereto without departing from the scope thereof.

The invention claimed is:

1. An apparatus for connection to an excavator or other machine, the apparatus including:

a hammer having an impacting end for impacting a working surface;

a drive mechanism for lifting the hammer;

a housing in which the hammer is received, the housing being configured for attachment to said machine, the impacting end of the hammer extending in use from an open end of the housing; and a locking mechanism including a locking member and an actuator, characterised in that the actuator is capable of forcing a hammer-engaging face of the locking member to engage at one or more points along a face of the hammer to lock the hammer within the housing such that the impacting end protrudes from the open end of the housing, thereby allowing the protruding end of the hammer to also be used for pushing or raking material, wherein the locking member engages with said face of the hammer by rotation about a first axis of rotation, the locking member having an eccentric rotational peripheral profile about said first axis of rotation via at least one intermediate linkage, pivotally attached about a second and third axis of rotation to the locking member and actuator respectively.

2. The apparatus as claimed in claim 1, wherein the locking member is a cam and the actuator pivots the cam to press a hammer-engaging face of the cam to engage with said face of the hammer to lock the hammer within the housing, the cam being shaped such that any force acting to push the hammer into the housing with the locking mechanism engaged acts to rotate the cam and thereby hold the hammer more firmly.

3. The apparatus as claimed in claim 1, wherein rotation of the locking member in the engaged position due to upward movement of the hammer increases the force of engagement engaged between the locking member and the hammer.

4. The apparatus as claimed in claim 1, wherein said rotation causes portions of the eccentric peripheral profile with an increasing radius into contact with the hammer.

5. The apparatus as claimed in claim 1, wherein the drive mechanism is mounted within the housing.

6. The apparatus as claimed in claim 1, wherein both the drive mechanism and actuator are hydraulically powered.

7. The apparatus as claimed in claim 1, wherein the apparatus is connected to an excavator or other machine via an articulated arm.

8. A method of locking a hammer within the housing of an apparatus adapted for connection to an excavator or other machine to allow an impacting end of the hammer to protrude from the open end of the housing enabling the protruding end of the hammer to be used for pushing and/or raking material, the apparatus including:

a hammer having an impacting end for impacting a working surface;

a drive mechanism for lifting the hammer;

a housing in which the hammer is received, the housing being configured for attachment to said machine, the impacting end of the hammer extending in use from an open end of the housing; and a locking mechanism including a locking member and an actuator, said method including:

activating the actuator to engage a hammer-engaging face of the locking member at a point along a face of the hammer to lock the hammer to the housing, wherein the locking member engages with said face of the hammer by rotation about a first axis of rotation, the locking member having an eccentric rotational peripheral profile about said first axis of rotation, the actuator causing rotation of the locking member about said first axis of rotation via at least one intermediate linkage, pivotally attached about a second and third axis of rotation to the locking member and actuator respectively.

9. The method as claimed in claim 8, wherein the hammer-engaging face of the locking member engages the hammer at any selected point along at least a portion of the hammer face.

* * * * *